United States Patent [19]

Sagers et al.

[11] Patent Number: 4,939,421

[45] Date of Patent: Jul. 3, 1990

[54] METHOD AND APPARATUS FOR REDUCING INTERFERENCE FROM LIGHT SOURCES

[75] Inventors: Richard C. Sagers, Fort Worth; Ralph E. Menick, Euless, both of Tex.

[73] Assignee: Motorola, Inc., Schaumburg, Ill.

[21] Appl. No.: 203,379

[22] Filed: Jun. 6, 1988

Related U.S. Application Data

[63] Continuation of Ser. No. 877,040, Jun. 23, 1986, abandoned.

[51] Int. Cl.[5] ..... H01J 1/52

[52] U.S. Cl. ..... 315/85; 315/86; 315/244; 315/77

[58] Field of Search ..... 315/85, 84.61, 86, 102, 315/103, 104, 244, 77, 307, 248, 276, 200 R, 275, 219, DIG. 4, DIG. 5; 313/570, 623, 635; 362/217, 260, 221; 333/175

[56] References Cited

U.S. PATENT DOCUMENTS

| | | | |
|---|---|---|---|
| 2,301,840 | 11/1942 | Yost | 315/103 |
| 3,496,508 | 2/1970 | Meijer | 315/104 |
| 3,599,051 | 8/1971 | Lee | 315/162 |
| 3,819,981 | 6/1974 | Diamond | 315/102 |
| 3,859,542 | 1/1975 | Kennedy | 333/76 |
| 4,075,476 | 2/1978 | Pitel | 315/278 |
| 4,190,790 | 2/1980 | Plumb et al. | 315/244 |
| 4,240,010 | 12/1980 | Buhrer | 315/85 |
| 4,277,726 | 7/1981 | Burke | 315/98 |
| 4,383,203 | 5/1983 | Stanley | 315/276 |
| 4,383,303 | 5/1983 | Stanley | 315/276 |
| 4,406,976 | 9/1983 | Wisbey et al. | 315/244 |
| 4,406,991 | 9/1983 | Strycula et al. | 333/175 |
| 4,481,426 | 11/1984 | Nakagawa et al. | 315/85 |
| 4,612,479 | 9/1986 | Zansky | 315/194 |
| 4,631,450 | 12/1986 | Lagree et al. | 315/244 |
| 4,641,061 | 2/1987 | Munson | 315/244 |
| 4,659,966 | 4/1987 | Roche | 315/73 |
| 4,661,890 | 4/1987 | Watanabe et al. | 362/217 |
| 4,667,131 | 5/1987 | Nilssen | 315/275 |
| 4,667,132 | 5/1987 | Leale | 315/282 |
| 4,673,843 | 6/1987 | Okanuma | 313/570 |
| 4,673,844 | 6/1987 | Maytum et al. | 315/200 R |
| 4,674,015 | 6/1987 | Smith | 362/217 |
| 4,682,082 | 7/1987 | MacAskill et al. | 315/219 |
| 4,682,084 | 7/1987 | Kuhnel et al. | 315/307 |

FOREIGN PATENT DOCUMENTS

| | | | |
|---|---|---|---|
| 2315038 | 10/1974 | Fed. Rep. of Germany | 315/85 |
| 2446579 | 9/1980 | France | 315/102 |
| 55-77378 | 6/1980 | Japan | 315/85 |

OTHER PUBLICATIONS

Encyclopedia Britannica, vol. 14, pp. 7–8, 1969.

*Primary Examiner*—Leo H. Boudreau
*Assistant Examiner*—Michael Razavi
*Attorney, Agent, or Firm*—Robert S. Babayi; Thomas G. Berry

[57] ABSTRACT

Disclosed is a method and apparatus for reducing radiated interference from a light source wherein a filter device is coupled across the light source after a predetermined time has expired from the starting of the light source. In this way, the filter does not interfere with the starting of the light source, however, after being coupled, the filter prevents radio frequency interference generated by the light source from radiating from the light source and associated wiring and interferring with nearby radio receiving equipment.

14 Claims, 1 Drawing Sheet

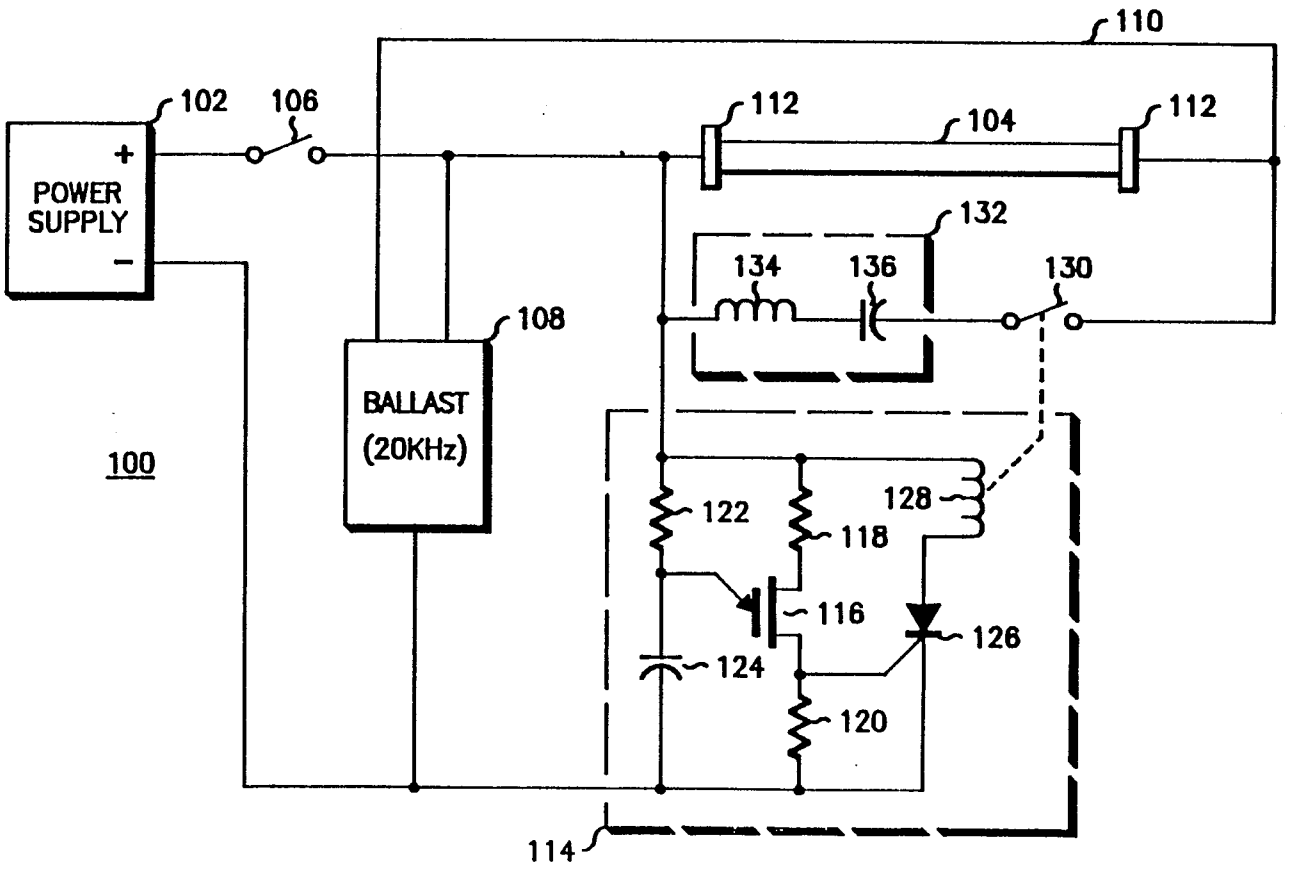
110
112
104
112
130
132
136
134
128
126
118
116
120
122
124
114
108
BALLAST
(20KHz)
106
102
POWER
SUPPLY
+
-
100

METHOD AND APPARATUS FOR REDUCING INTERFERENCE FROM LIGHT SOURCES

This is a continuation of application Ser. No. 877,040, filed June 23, 1986 now abandoned.

TECHNICAL FIELD

This invention relates generally to lighting fixtures and more particularly to non-incandescent lighting fixtures, and is more particularly directed to a method and apparatus for reducing radio frequency interference caused by non-incandescent lighting sources.

BACKGROUND ART

Currently, mass transportation carriers are widely used in our modern society. Mass transportation carriers, such as trains and buses, are particularly useful in crowded urban areas where traffic congestion is a problem. Typically, trains and buses employ several light sources for the safety and convenience of its passengers. Among the possible choices of light sources, the fluorescent light tube is generally preferred over the incandescent bulb due mainly to its economics of operation and the reduced heat generated by the fluorescent tube.

With the advent of automatic vehicle location (AVL) systems, such as the "Loran-C" system, many mass transportation vehicles have been equipped with AVL devices so that a provider of a mass transportation service can determine the location of its vehicles. However, when an AVL device is installed in a vehicle employing fluorescent lights, the AVL device may be rendered inoperative due to the radio frequency (RF) interference radiated by the fluorescent lights and associated wiring.

One approach to reduce the RF interference from the fluorescent lights included the installation of a grounded wire grid that surrounded the fluorescent tube. However, this screening technique is expensive to implement, reduces the light output from the fluorescent tube and renders the normally easy task of replacing an inoperative tube a tedious and laborious process. Accordingly, a need exists to develop a means for suppressing the radio frequency interference generated by the fluorescent lights so that mass transportation vehicles may be equipped with the benefit of the AVL devices, while maintaining proper lighting for the safety and convenience of the passengers.

SUMMARY OF THE INVENTION

Accordingly, it is an object of the present invention to provide a method and apparatus reducing interference from light sources while avoiding the detriments of the prior art.

Briefly, according to the invention, a filter means is coupled across a light source after a predetermined time has expired from the starting of the light source. In this way, the filter does not interfere with the starting of the light source, however, after being coupled, prevents radio frequency interference radiated by the light source from interferring with nearby AVL equipment.

BRIEF DESCRIPTION OF THE DRAWING

The features of the present invention which are believed to be novel are set forth with particularity in the appended claims. The invention, together with further objects and advantages thereof, may be understood by reference to the following description taken in conjunction with the accompanying drawing FIGURE which is a part-schematic, part-block diagram of the present invention.

DETAILED DESCRIPTION OF THE PREFERRED EMBODIMENT

Referring now to the drawing FIGURE, there is shown the preferred embodiment of the present invention 100. In operation, a power supply 102, which in the case of trains and buses may be a DC power supply, is coupled to the light source 104 via a switch 106. Closing the switch 106 supplies power to the ballast 108 which has a "firing" line 110 coupled to the light source 104. Typically, the light source 104 is held in place by a sockets 112 to facilitate replacement. The light source 104 may be a fluorescent light tube or other gas (or vapor filled) tube as may be desired in a particular installation. In a DC implementation, the ballast 108 fires the light source 104 by periodically pulsing (typically at 20 kHz) the firing line 110. The ballast 108 may also contain the starting circuitry for the light source 104. Typically, in fluorescent (or vapor filled) light sources, a high voltage pulse is required to initiate the flow of electrons across the light tube 104 thereby generating light.

When the switch 106 is closed to start the light source 104, power is also supplied to the time delay circuit 114, the time delay circuit 114 is comprised of a uni-junction transistor (UJT) 116 with associated biasing resistors 118 and 120, an R-C delay, and a silicon controlled rectifier (SCR) 126. The UJT 116 is controlled by the resistor 122 and the capacitor 124, which form an R-C time constant that applies an appropriate DC bias on the gate of the UJT 116 after a predetermined charging time in the well known R-C time constant manner. When the UJT 116 is conducting, it "fires" the gate of the SCR 126. When the SCR 126 fires, it allows current to flow through the coil 128, which energizes the switch 130, thereby coupling the filter 132 across the light source 104. Thus by an appropriate selection for the values of the resistor 122 and the capacitor 124, the desired time delay can be implemented. In the preferred embodiment of the present invention, the time delay is seven (7) seconds, which is provided by the resistor 122 value of 620 kohms and the capacitor 124 value of 10 $\mu$F.

The primary purpose for the delayed coupling of the filter 132 across the light source 104 is to prevent the reactive value of the filter 132 from interfering with the initial starting of the light source 104. As previously mentioned, the ballast 108 provides a high voltage pulse to start the initial flow of electrons through the light source. The coupling of external inductive and capacitive filter elements to the ballast 108 may alter the reactive impedance of the ballast, thereby preventing the light source 104 from starting. Accordingly, the invention contemplates a delayed coupling so that the bulb may be properly started, and then, the filter switched into place to prevent the light source from interfering with any AVL equipment. The filter 132 is preferably a notch filter centered around 100 kHz. This selection is based upon the use by AVL receivers of the 100 kHz frequency. Typically, the ballast 108 pulses the firing line 110 at approximately 20 kHz, which fires the bulb 104 at a corresponding 20 kHz rate. The electron discharge through the bulb 104 produces harmonics spaced at integer multiples of the firing line frequency as is well known in the art. Thus, for a 20 kHz firing rate, the harmonics are approximately 40 kHz, 60 kHz, and so on. Accordingly, the fifth harmonic (i.e., 100 kHz) must be removed to prevent interference in the AVL equipment. Preferably, a wide bandwidth (i.e., low Q) notch filter 132 is used. The 3 dB bandwidth of the notch filter 132 (preferably at least 75 kHz) should be wide enough to allow for both temperature and manufacturer part-to-part variations. In the preferred embodiment of the present invention, the 3 dB bandwidth is 80 kHz and is brought about by a high C-to-L ratio to bring about a low Q (preferably less than 1.4). In the preferred embodiment of the present invention, the value of the inductor 134 is 0.5 mH and the value of the capacitor 136 is 5000 pF although other values may be used in a particular implementation. The filter 132 prevents the 5th harmonic (100 kHz) generated by the bulb 104, and associated wiring, from being radiated to the AVL equipment thereby rendering it inoperative.

While a particular embodiment of the invention has been described and shown, it should be understood that the invention is not limited thereto since many modifications may be made. In particular, alternate time delays may be implemented by selecting other values for the resistor 122 or the capacitor 124 or various bandwidths of the filter 132 may also be selected by changing component values. Additionally, temperature compensation and other such circuits may be added without departing from the teachings of the present invention. It is therefore contemplated that covered by the present application are any and all such modifications that may fall within the true spirit and scope of the basic underlying principles disclosed and claimed herein.

What is claimed is:

1. An apparatus for reducing radiated interference from light sources operating in vehicles having automatic vehicle location equipment, comprising in combination:

(a) a vehicle having automatic vehicle location equipment operating at an operational frequency; and, (b) at least one light source that may radiate interference at said operational frequency of said automatic vehicle location equipment thereby degrading proper performance of said automatic vehicle location equipment, said at least one light source comprising:

(i) a DC power source;

(ii) ballast means, selectably coupled to said DC power source;

(iii) means for generating light, coupled to said ballast means and selectably coupled to said DC power source;

(iv) means for mounting said means for generating light within said vehicle having said automatic vehicle location equipment;

(v) timer means, coupled to said ballast means and selectably coupled to said DC power source, for providing a signal after a predetermined time delay; and (vi) filter means for filtering said radiated interference generated by said means for generating light, said filter means having a frequency approximately equal to said operational frequency of said automatic vehicle location equipment, and said filter means being selectably coupled across said means for generating light in response to said signal thereby facilitating proper performance of said automatic vehicle location equipment.

2. An apparatus for reducing radiated interference from light sources operating in vehicles having automatic vehicle location equipment, comprising in combination:

(a) a vehicle having automatic vehicle location equipment operating at 100 kHz; and, (b) at least one fluorescent light source that may radiate interference at 100 kHz thereby degrading proper performance of said automatic vehicle location equipment, said at least one fluorescent light source comprising:

(i) a DC power source;

(ii) ballast means, selectably coupled to said DC power source;

(iii) means for generating fluorescent light, coupled to said ballast means and selectably coupled to said DC power source;

(iv) means for mounting said means for generating fluorescent light within said vehicle having said automatic vehicle location equipment;

(v) timer means, coupled to said ballast means and selectably coupled to said DC power source, for providing a signal after a predetermined time delay; and (vi) notch filter means for filtering said radiated interference generated by said means for generating fluorescent light, said filter means having a frequency approximately equal 100 kHz, and said filter means being selectably coupled across said means for generating fluorescent light in response to said signal thereby facilitating proper performance of said automatic vehicle location equipment.

3. The apparatus of claim 1, wherein said light generating means comprises a fluorescent light source.

4. The apparatus of claim 1, wherein said predetermined time delay is seven seconds.

5. The apparatus of claim 1, wherein said filter means is a notch filter.

6. The apparatus of claim 5, wherein said notch filter is centered around 100 kHz.

7. The apparatus of claim 5, wherein said notch filter has a circuit Q less than 1.4.

8. The apparatus of claim 5, wherein said notch filter has a 3 dB bandwidth of at least 75 kHz.

9. The apparatus of claim 2, wherein said predetermined time delay is seven seconds.

10. The apparatus of claim 2, wherein said notch filter has a circuit Q less than 1.4.

11. The apparatus of claim 2, wherein said notch filter has a 3 dB bandwidth of at least 75 kHz.

12. In a vehicle having automatic vehicle location equipment operating at an operational frequency, and fluorescent lighting sources that may radiate interference at said operational frequency of said automatic vehicle location equipment thereby degrading proper performance of said automatic vehicle location equipment, a method for reducing said radiated interference from said fluorescent lighting sources at least near said operational frequency of said automatic vehicle location equipment, comprising the steps of:

(a) generating a first signal in response to providing a DC power signal;

(b) generating light in response to said first signal;

(c) providing a delay signal after a predetermined time delay from step (a);

(d) coupling a notch filter means having a center frequency approximately equal to said operational frequency of said automatic vehicle location equipment across a light generator in response to said delay signal thereby reducing said radiated interference generated by said fluorescent lighting sources and facilitating proper performance of said automatic vehicle location equipment;

(e) receiving at least one signal with said automatic vehicle location equipment.

13. In a vehicle having automatic vehicle location equipment operating at 100 kHz, and fluorescent lighting sources that may radiate interference at said 100 kHz operating frequency of said automatic vehicle location equipment thereby degrading proper performance of said automatic vehicle location equipment, an method for reducing said radiated interference from said fluorescent lighting sources at least near said 100 kHz operating frequency of said automatic vehicle location equipment, comprising the steps of:

(a) generating a first signal in response to providing a DC power signal;

(b) operating a fluorescent light generating means for providing light in response to said first signal;

(c) providing a delay signal after a predetermined time delay from step (a);

(d) coupling a notch filter means having a center frequency of approximately 100 kHz across said fluorescent light generating means in response to said delay signal thereby reducing said radiated interference at least near 100 kHz and facilitating proper operation of said automatic vehicle location equipment;

(e) receiving at least one signal with said automatic vehicle location equipment.

14. In a vehicle having automatic vehicle location equipment operating at 100 kHz, and fluorescent lighting sources that may radiate interference at approximately said 100 kHz operating frequency of said automatic vehicle location equipment thereby degrading proper performance of said automatic vehicle location equipment, an apparatus for said reducing radiated interference from said fluorescent lighting sources at least near said 100 kHz operating frequency of said automatic vehicle location equipment, comprising in combination:

a DC power source;

ballast means, selectably coupled to said DC power source;

fluorescent light generating means, coupled to said ballast means and selectably coupled to said DC power source, comprising:

a fluorescent light tube having electrodes for connecting same to a mounting means;

said means for mounting said fluorescent light generating means within said vehicle having automatic vehicle location equipment;

time delay means, coupled to said ballast means and selectably coupled to said DC power source, for providing a delay signal approximately seven seconds after being coupled to said DC power source;

notch filter means, having a center frequency of approximately 100 kHz, for filtering said radiated interference generated by said fluorescent light generating means having a frequency approximately equal to said 100 kHz operating frequency of said automatic vehicle location equipment, said notch filter means being selectably coupled across said fluorescent generating means, in response to said delay signal such that said notch filter means becomes selectively coupled across said fluorescent light generating means approximately seven seconds after said fluorescent light generating means has been stated by said ballast means thereby facilitating proper performance of said automatic vehicle location equipment.

* * * * *